US007882991B2

(12) United States Patent
Schechter

(10) Patent No.: US 7,882,991 B2
(45) Date of Patent: Feb. 8, 2011

(54) FOOD CONTAINER HAVING DRINKING OR REFUSE CUP

(76) Inventor: Frederick M. Schechter, 4618 El Centro Ave., Apt. C, Oakland, CA (US) 94602

( * ) Notice: Subject to any disclaimer, the term of this patent is extended or adjusted under 35 U.S.C. 154(b) by 943 days.

(21) Appl. No.: 11/801,445

(22) Filed: May 10, 2007

(65) Prior Publication Data

US 2008/0279988 A1 Nov. 13, 2008

(51) Int. Cl.
*B65B 25/00* (2006.01)

(52) U.S. Cl. ..... 222/553; 222/48; 222/192; 222/541.1; 222/171; 426/115; 426/123; 220/253; 220/505

(58) Field of Classification Search ..... 222/48, 222/192, 541.1, 544, 548, 553, 167–169, 222/171; 220/253, 505; 426/112, 115, 119, 426/120, 122, 123; 215/6; 206/541
See application file for complete search history.

(56) References Cited

U.S. PATENT DOCUMENTS 2,827,194 A * 3/1958 Matton ..... 215/227
5,000,387 A * 3/1991 Szuhay ..... 239/374
5,664,671 A 9/1997 Nedblake, Jr.
5,722,558 A * 3/1998 Thompson ..... 220/521
5,881,868 A 3/1999 Soyak et al.
6,060,097 A 5/2000 Grigoryan
6,966,468 B2 * 11/2005 McKay et al. ..... 222/486
6,989,168 B2 1/2006 Fahey

* cited by examiner

*Primary Examiner*—J. Casimer Jacyna
(74) *Attorney, Agent, or Firm*—Richard A. Ryan

(57) ABSTRACT

A food container particularly configured for use with food products having a refuse component, such as sunflower seeds having shells and cherries having pits. The food container comprises an inner cup having a wall that encloses a receptacle that is open at the top and a chamber that is closed at the bottom. A divider separates the chamber, which stores the food product for consumption, from the receptacle, which receives the refuse. The inner cup is rotatably received in a sleeve. The consumer rotates the sleeve to align an outer opening thereon with an inner opening on the inner cup to dispense food product from the chamber. A cover closes the outer opening and prevents rotation of the sleeve. A beverage can be served in the receptacle. An indexing mechanism and a rotation mechanism can be incorporated into the food container. The food product chamber can include a freshness seal.

20 Claims, 9 Drawing Sheets

FOOD CONTAINER HAVING DRINKING OR REFUSE CUP

CROSS-REFERENCE TO RELATED APPLICATIONS

None.

BACKGROUND OF THE INVENTION

A. Field of the Invention

The field of the present invention relates generally to the packaging and serving of foods and beverages in multiple use containers. More particularly, the present invention relates to the packaging and serving of foods that have a portion which is eaten and a portion which is refuse. Even more particularly the present invention relates to the packaging and serving of such foods in a single container that has an area which stores the uneaten food and an area which can be used for a beverage and/or to receive the refuse portion of the food.

B. Background

Many people enjoy eating snack type foods while watching or participating in another activity, including watching sporting events such as a baseball, basketball, football and soccer games or horse and automobile racing, watching a movie or television, driving or riding in a vehicle, or just relaxing by the pool or on the beach. Many of these snack types of foods have a portion which is eaten by the consumer and a refuse portion which is not eaten and must be disposed of by the consumer. Hereinafter, such types of foods are collectively referred to as "food products" and the refuse portion is collectively referred to as "food-related refuse" or "refuse". Examples of such food products include nuts, sunflower seeds, pumpkin seeds, olives and cherries. The food-related refuse associated with these food products include shells and seeds. With regard to these and related food products, the consumer must either first break open the shell to get to the consumable inner portion of the food product, as with nuts and sunflower seeds for example, or eat through the food product to the seed at the center thereof, as with olives and cherries for example. As well known to those familiar with these food products, whether they enjoy eating them or they have to clean up after others who enjoy eating the food products, the primary negative aspect of these types of food products is that the food-related refuse can result in a significant amount of debris.

Although sunflower seeds and other types of food products are occasionally provided in plastic cups and cardboard boxes, packaging for the food products typically comprises a quantity of individual items of the food product packaged in a plastic bag-type of packaging or placed in a paper or paper-like sack. The consumer usually removes one or more of the individual food products from the package for consumption. Once the consumer removes the outer shell or eats the consumable portion, he or she is left with the food-related refuse for disposal. If the consumer is eating the food product at home, he or she generally has a trash can or other trash receptacle readily available, meaning at or near the person's location, for receiving the food-related refuse. However, if the consumer is eating the food products at a sporting event or is outside of the home, such trash receptacles are not usually readily available. As a result, the consumer of food products typically disposes the food-related refuse in a manner that is most convenient to him or her. While some people are diligent about placing the food-related refuse into a container of some type that can then be transferred to a trash receptacle, many people tend to just dispose the refuse on the ground near where they are sitting or standing. This is particularly true of the small, shelled food products such as sunflower seeds, pumpkin seeds and nuts. Some of these, particularly the sunflower and pumpkin seed products, tend to be spit out by the consumer after he or she has separated the shell from the edible portion in his or her mouth. As many people have seen, the consumption of food products can result in a large amount of food-related refuse laying on the ground, floor or other surface around the person eating the food products. For instance, it is not an uncommon sight at a baseball game to see a rather larger pile of sunflower seed shells at the feet of a fan or player at the end of the game.

One of the problems with the above food products is that they are usually packaged and served to the consumer in a single container that holds the uneaten food product with, generally, no real concern given to where the person is supposed to dispose of the naturally occurring food-related refuse. As a result, the consumer is typically left to fend for himself or herself with regards to disposal of the food-related refuse. Those persons who do not choose to drop or spit out the refuse onto the ground generally obtain an empty cup, can, bag or sack in which to dispose of the food-related refuse. In fact, it is not uncommon for such a person to grab an empty soda or beer cup or can, whether it is theirs or not, to be able to drop or spit the refuse into for later disposal. Use of cups, cans or the like that were previously utilized for drinks, particularly if they belong to others and/or are not completely empty, can create other mess, time-consuming and hygiene issues.

One example of a product that is the result of some thought into the consumer's need to dispose of the food-related refuse when consuming food products is the David® sunflower seed "Travel Cup" product by ConAgra Foods, Inc. This product packaging comprises a bag of sunflower seeds disposed inside a plastic cup. The intent appears to be that someone removes the bag of seeds from the plastic cup and then spits or otherwise disposes the food-related refuse inside the cup (hence the Spit Responsibly™ slogan). Although the product does provide the consumer with a readily available cup for disposal of the refuse, thus eliminating the need to seek out a cup, the product does require the consumer to handle and manipulate two separate containers, one containing sunflower seeds and one for the refuse, while simultaneously retrieving seeds from the bag and disposing them (presumably preferably by spitting) into the cup. The cup and its contents are then disposed of or the cup is emptied and then cleaned for reuse.

Over the years, multiple use containers have been developed to package and serve food, beverage or other items to the consumer. For instance, U.S. Pat. No. 6,060,097 to Grigoryan discloses a food cup comprising an elongated cardboard outer cylinder in which is disposed, at the lower end thereof, an inner cylinder open at both ends. A mouth opens in the lower part of the outer container and food passes from the inner container past teeth which limit the flow of food. A waste cup is placed inside the upper part of the outer container. In use, the waster cup moves down the outer container chamber as food is removed through the mouth and waste is placed in the waste cup. A beverage cup can be placed in the top cover of the outer container. U.S. Pat. No. 5,664,671 to Nedblake, Jr. describes a combination container comprising a first container having a beverage and a second container, at the base of the first container, having an edible solid. A band of heat-shrunk material surrounds the containers on either side of where they abut for coupling the two containers together. U.S. Pat. No. 6,989,168 to Fahey describes a dual compartment beverage container for dispensing a single serving of beverage and snack food. The container wall is configured to define two product containment regions, a recess for receiving a cartridge containing food and a compartment for containing a beverage. U.S. Pat. No. 5,881,868 to Soyak, et al. describes a container for liquid and tobacco products that is configured as a bottle for the liquid with a recess area disposed in the bottle and open at the bottom to receive cigars. A seal closes the opening to keep the cigars fresh and humidified.

Except for the patent to Grigoryan, none of the foregoing prior art devices provides a food container suitable for use with a food product having a food-related refuse associated therewith. The food cup of Grigoryan appears to be somewhat inconvenient for use in most situations where the user would desire to consume food products. What is needed, therefore, is an improved food container that packages a food product for serving to the consumer and provides the consumer an easy to use, convenient disposal area for receiving the food-related refuse. The preferred food container will have an area that stores the food product for consumption, a controllable opening configured to selectively dispense a portion of the food product from the container and an area that easily and conveniently receives the food-related refuse. Preferably, the food container is configured so the user does not have to hold and manipulate multiple packages while he or she retrieves food product from the container and disposes the food-related refuse therein. The preferred food container will be made out of materials that results in a lightweight, versatile and relatively inexpensive to manufacture packaging system that is readily disposable and recyclable/biodegradable.

SUMMARY OF THE INVENTION

The food container having a drinking or refuse cup of the present invention solves the problems and provides the benefits identified above. That is to say, the present invention discloses an improved multiple use food container that provides a packaging system which stores a food product for consumption and provides a convenient and easy to utilize receptacle for receiving the food-related refuse. In a preferred embodiment of the present invention, the food container is adaptable for use with a wide variety of food products that have food-related refuse associated therewith, including nuts, sunflower seeds and olives that have shells or seeds. The preferred embodiment of the food container of the present invention has a sealed area for storing the food product until it is ready for consumption, an easy to control opening that allows the user to selectively dispense a desired quantity of food product from the container and a receptacle for receiving the food-related refuse until it is ready for disposal. The food container of the present invention provides and easy to use food packaging and serving system that allows the user to dispense a food product and dispose of food-related refuse without having to manipulate multiple packages. The food container can be made out of a variety of materials, including those that provide a lightweight, versatile and inexpensive to manufacture food container which is disposable and recyclable. In use, the food container of the present invention provides improved consumer convenience and functionality with regard to the packaging and serving of food products. The all-in-one food container is sealed to maintain the freshness of the food product while providing a system that makes it is easier to eat the food product in a neat and clean manner without having to obtain a separate disposal receptacle.

In one general aspect of the present invention, the food container having a drinking or refuse cup comprises an inner cup rotatably disposed in an outer sleeve. The inner cup has a first wall that encloses an upper receptacle and a lower chamber between the upper end of the first wall and the lower end of the first wall. In the preferred embodiment, a fixed divider separates the upper receptacle from the lower chamber. The lower chamber is configured to store the food product therein. The upper end of the inner cup is substantially open to define a cup-like receptacle that is configured to receive the food-related refuse therein. In some embodiments, the cup first holds a beverage for consumption by the consumer prior to receiving the food-related refuse. The first wall has an inner dispensing opening that is in communication with the lower chamber to allow the food product to pass therethrough. The outer sleeve has a second wall that encloses a cup receiving chamber that is open at the upper end of the second wall. The inner cup is received into the receiving chamber through the open upper end. The second wall has an outer dispensing opening that is configured to selectively dispense the food product from the food container when it is aligned with the inner cup's inner dispensing opening. The outer dispensing opening is closed by a removable cover that is also configured to prevent rotation of the inner cup and outer sleeve. In a preferred embodiment, the outer sleeve is disposed between an upper locking ring at the upper end of the inner cup and a lower locking ring at the lower end of the inner cup in a manner that prevents substantial vertical movement of the outer sleeve while permitting it to rotate. The preferred embodiment also includes an indexing mechanism that comprises a plurality of detent bumps on the inner cup and a plurality of cooperatively configured and positioned detent holes on the outer sleeve. Other types of indexing devices can also be utilized. Preferably, the outer sleeve has a grip slot in the second wall that is configured to allow contact with the first wall of the inner cup to assist the consumer with the desired rotation. Alternatively, or in conjunction with the slot device, a gripping surface can be used on the outer sleeve instead of using the slot device. In one configuration, the inner dispensing opening in the first wall of the inner cup comprises a pair of diagonally shaped slots that are spaced apart a distance at least as great as the width of the outer dispensing opening. The lower chamber can include a freshness seal to help keep the food product fresh until consumption.

In use, the consumer removes the removable cover so that he or she may twist or rotate the outer sleeve, typically be utilizing the grip slot in the outer sleeve. When the inner dispensing opening comes into alignment with the outer dispensing opening, the consumer punctures the freshness seal with a finger to access the food product in the lower chamber. The visible opening will slide down the vertical slot of the outer dispensing opening after additional rotation of the outer sleeve. Once the user has the opening at the desired level, he or she merely pours or shakes a quantity of the food product out of the food container onto his or her hand. A twist in the opposite direction on the outer sleeve closes the food container, reduces the size of the opening or increases the height of the opening holes depending on the embodiment and previous rotational position. In an alternative use, the food container can be served with a beverage in the upper receptacle. Once the beverage is consumed, the consumer can place the food-related refuse in the upper receptacle. When the food product is fully consumed, the consumer can dispose of the entire food container, including the food-related refuse, or place it in a recycling receptacle.

Accordingly, the primary objective of the present invention is to provide an improved multiple use food container for food products that provides the advantages discussed above and overcomes the disadvantages and limitations associated with presently available food containers and packaging systems for food products.

It is also an important object of the present invention to provide a food container that packages a food product for serving to the consumer and provides an easy to use and convenient receptacle for receiving the food-related refuse associated with the food product.

It is also an important object of the present invention to provide a food container for use with food products having food-related refuse that provides a sealed compartment for serving the food product, a controllable opening for dispensing a desired quantity of food product from the compartment and a receptacle that receives the food-related refuse.

It is also an important object of the present invention to provide a food container that does not require the consumer to handle multiple packages while trying to remove a quantity of food product from one of the packages and dispose of the food-related refuse in a separate container.

It is also an important object of the present invention to provide a food container that comprises an inner cup having an upper receptacle for receiving food-related refuse and a lower chamber for storing fresh food product that is rotatably disposed in an outer sleeve having a dispensing opening which cooperatively engages an opening in the lower chamber to allow the user to selectively dispense a desired quantity of food product and conveniently and cleanly dispose of the food-related refuse.

It is also an object of the present invention to provide a food container having the above and other packaging/serving features that is lightweight, adaptable to a variety of food products, relatively inexpensive to manufacture and disposable.

It is also an object of the present invention to provide a food container that can be sleeve stacked, or otherwise efficiently stored and presented, at the point of purchase.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of a preferred embodiment and represents one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein are primarily described as being utilized with food products having shells or seeds, those skilled in the art will readily understand that this is merely for purposes of simplifying the present disclosure and that the present invention is not so limited. For instance, the present invention is equally applicable for use with other foods and combinations of foods and beverages, such as individually wrapped snacks or hot chocolate and marshmallows.

Figure 1:
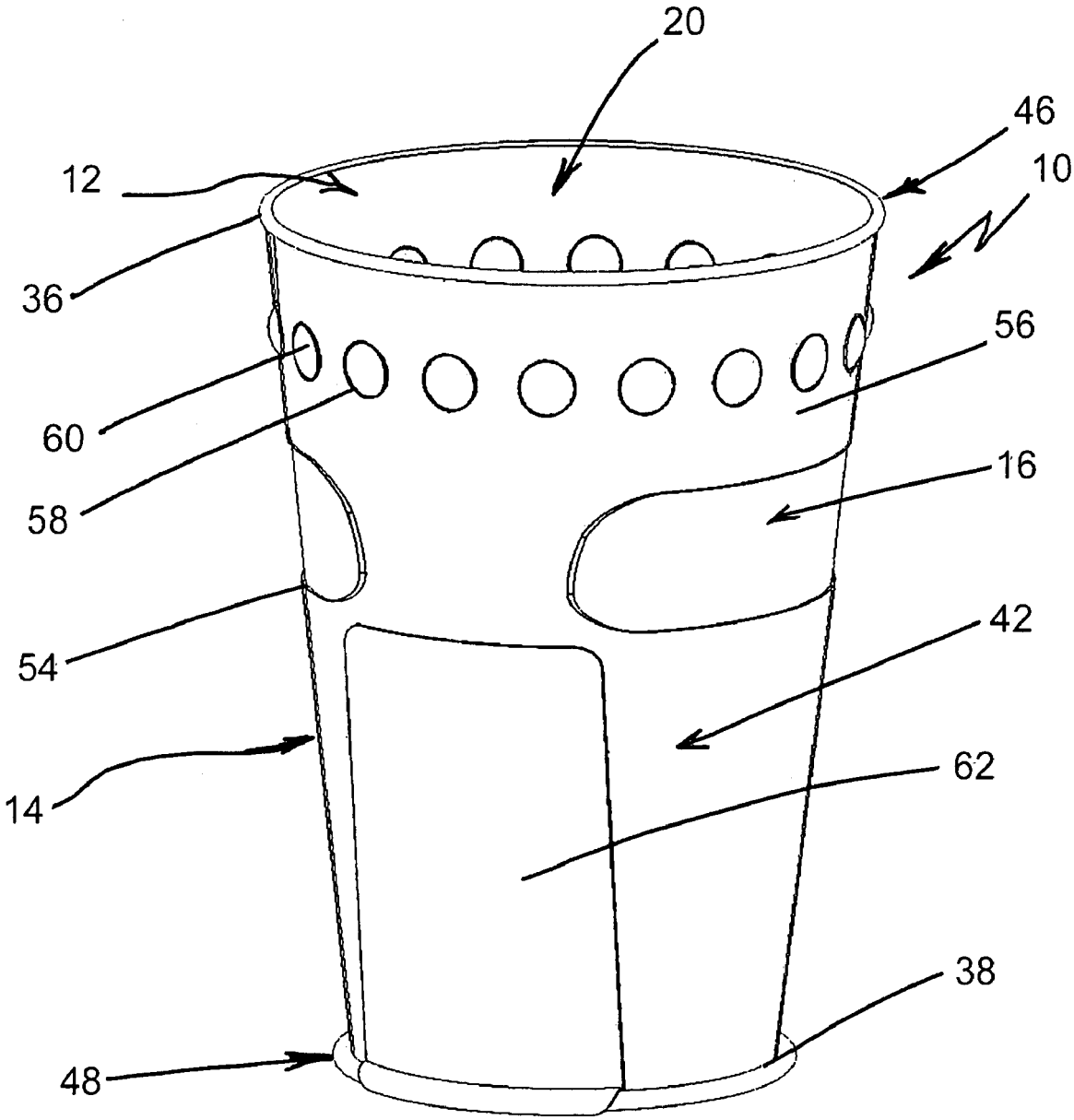
FIG. 1 is front view of a food container configured according to a preferred embodiment of the present invention showing the removable cover in place.
Figure 2:
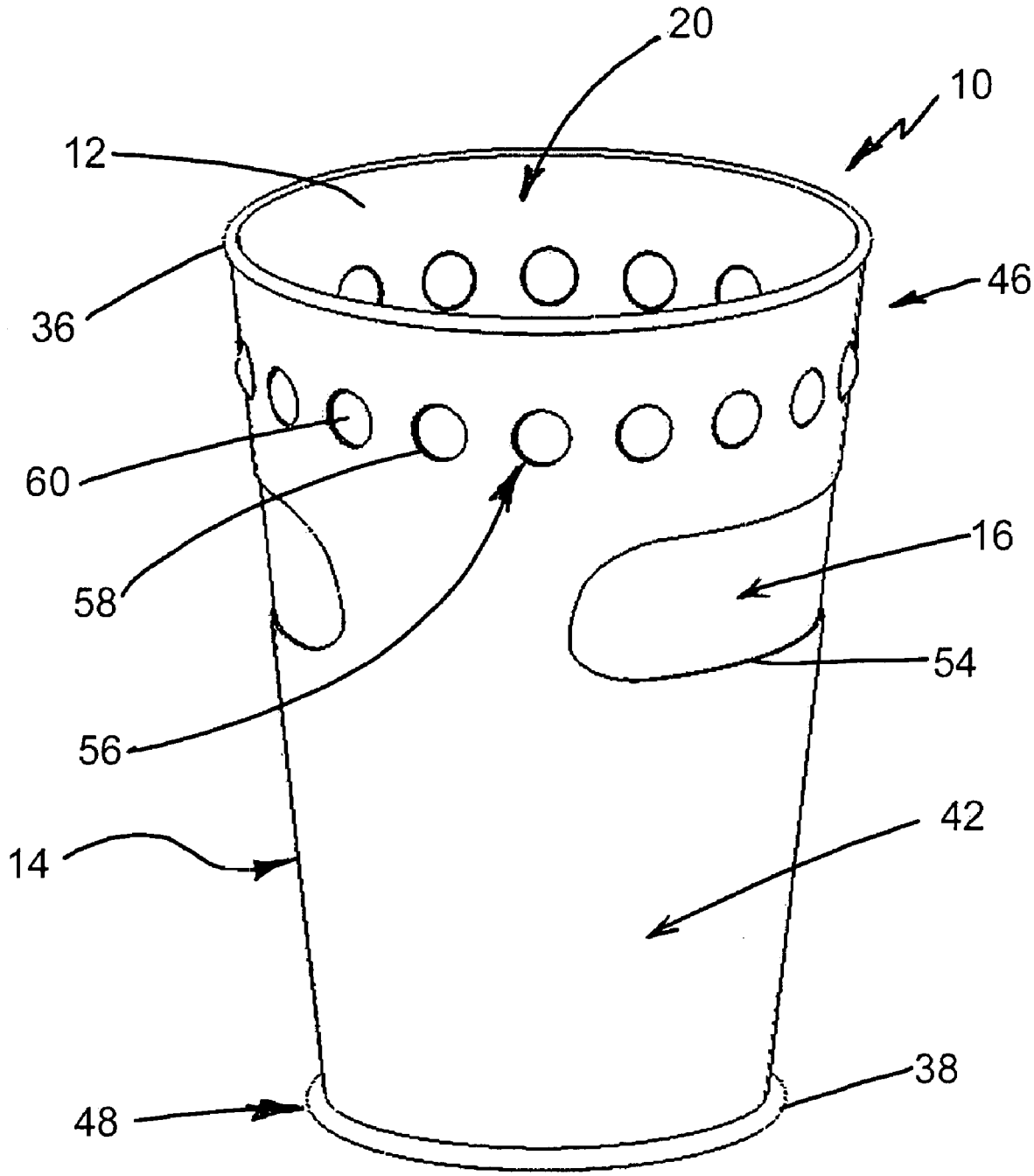
FIG. 2 is a back view of the food container shown in FIG. 1.
Figure 3:
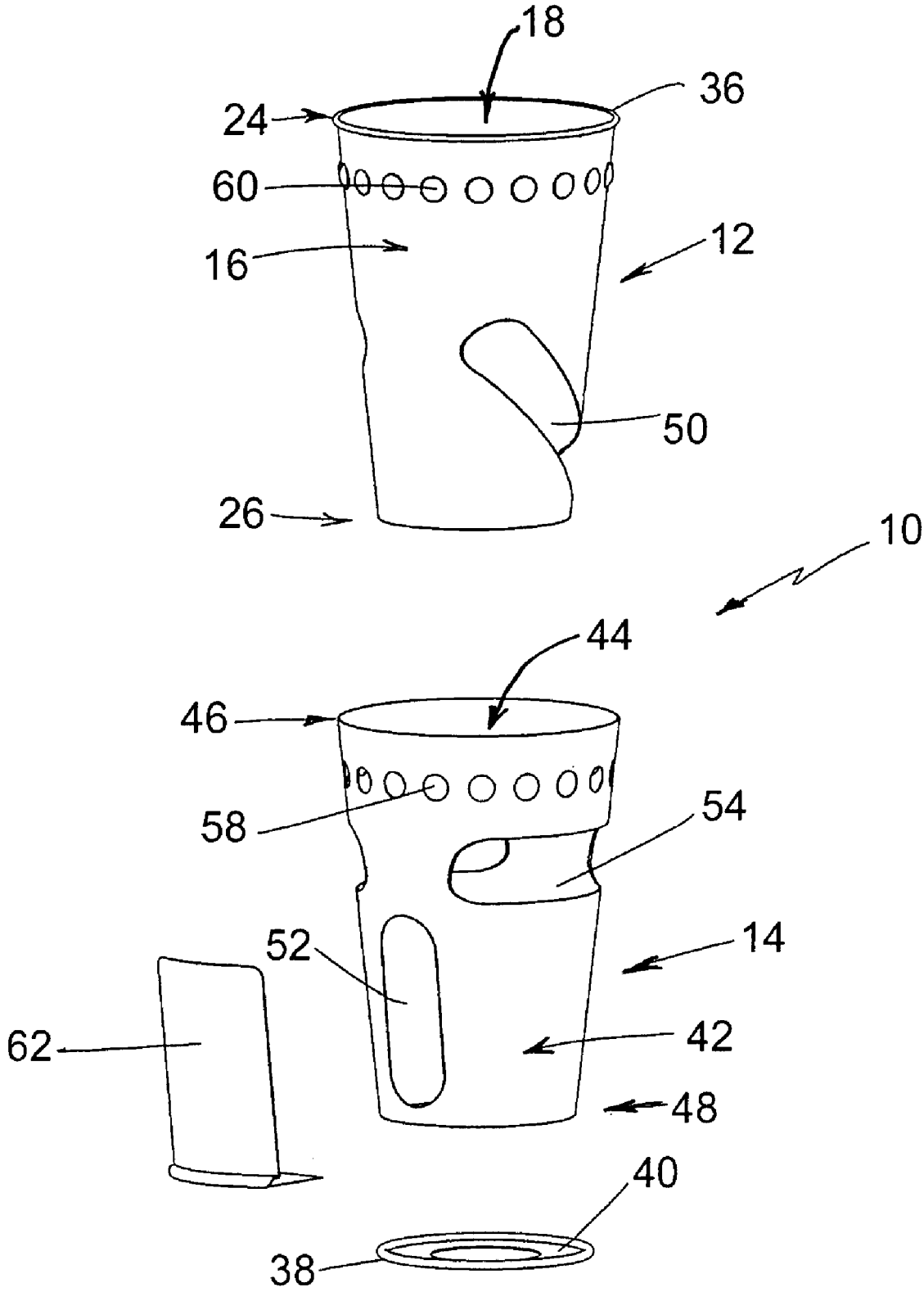
FIG. 3 is a partially exploded front view of the food container of FIG. 1 shown with the inner cup, removable cover and lower lock member removed therefrom.

A food container that is manufactured out of the components and configured pursuant to a preferred embodiment of the present invention is shown generally as 10 in the figures. As shown in FIGS. 1 through 3, food container 10 comprises an inner cup 12 and an outer sleeve or cup 14 that, as set forth in more detail below, are configured to cooperate together to provide a packaging and serving system for food products that also provides a convenient place to dispose of the food-related refuse. Inner cup 12 is rotatably received inside outer sleeve 14 such that the consumer will rotate or twist the inner cup 12 and/or the outer sleeve 14 relative to each other in order to place the food container 10 in position to dispense the food product therefrom. Typically, the consumer will hold food container 10 in one hand and then tilt food container 10 to pour or shake out a desired quantity of food product onto his or her other hand, from which at least the edible portion is transferred to the mouth for consumption, or the food product will be directly transferred to the consumer's mouth by tipping the food container at the mouth. Although inner cup 12 and outer sleeve 14 can be made from a wide variety of materials, it is preferred that the materials be selected as being lightweight, easy to grip, disposable and suitable for recycling. An example of such material is molded pulp, paper, cardboard, plastic or any combination(s) thereof.

Figure 4:
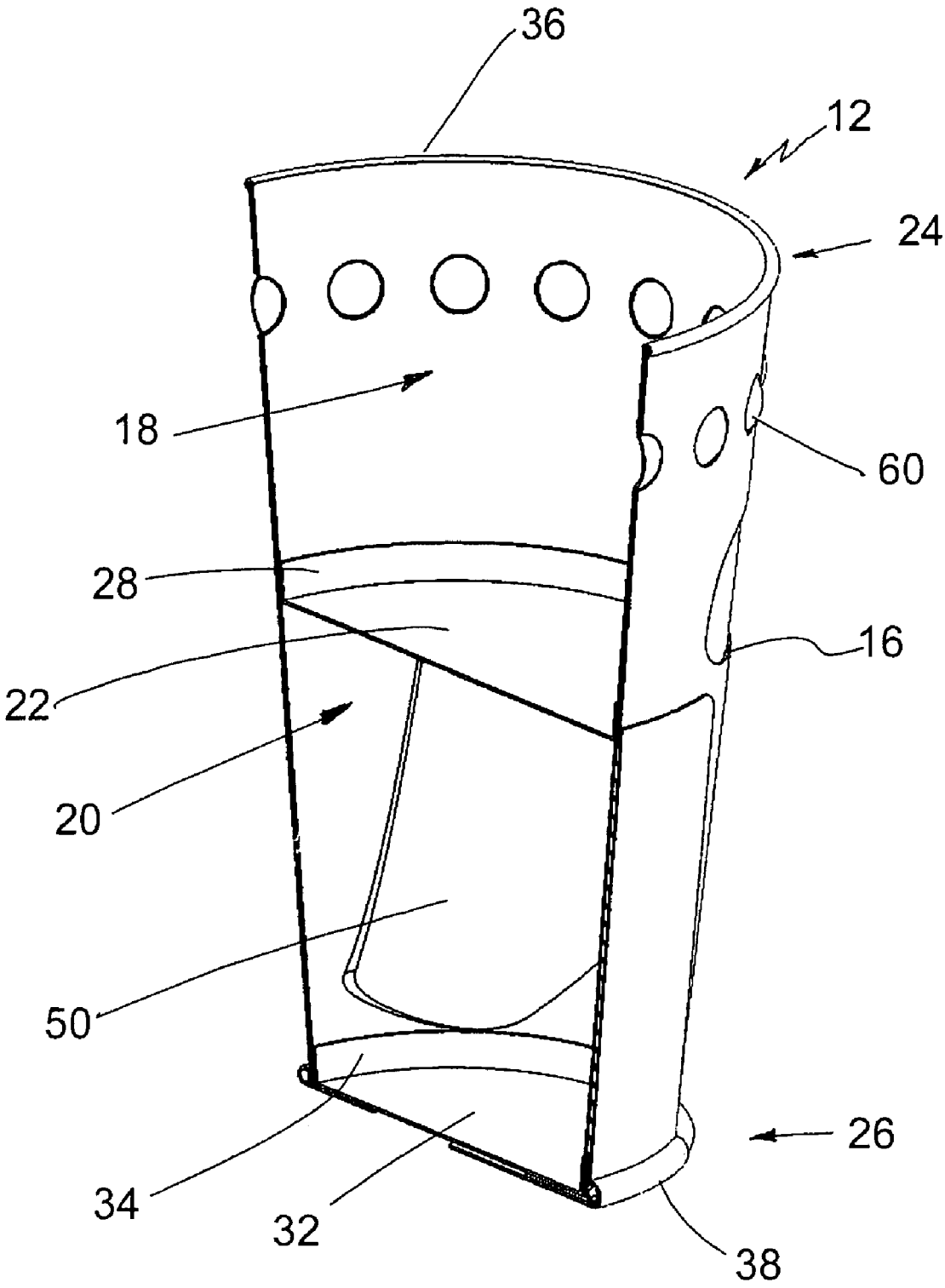
FIG. 4 is a cross-sectional view of the inner cup of the food container shown in FIG. 3.
Figure 5:
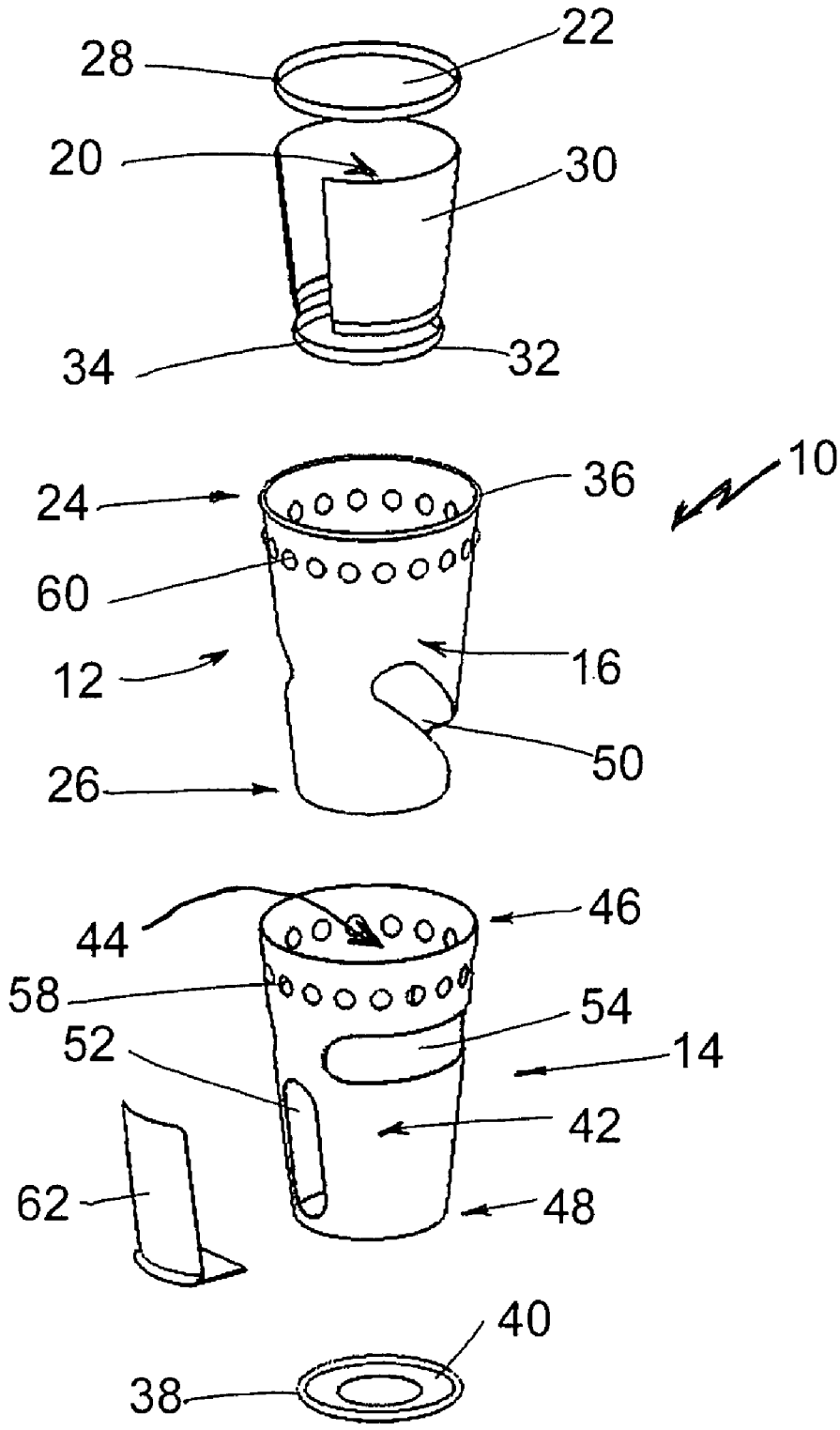
FIG. 5 is a fully exploded front view of the food container of FIG. 1.
Figure 6:
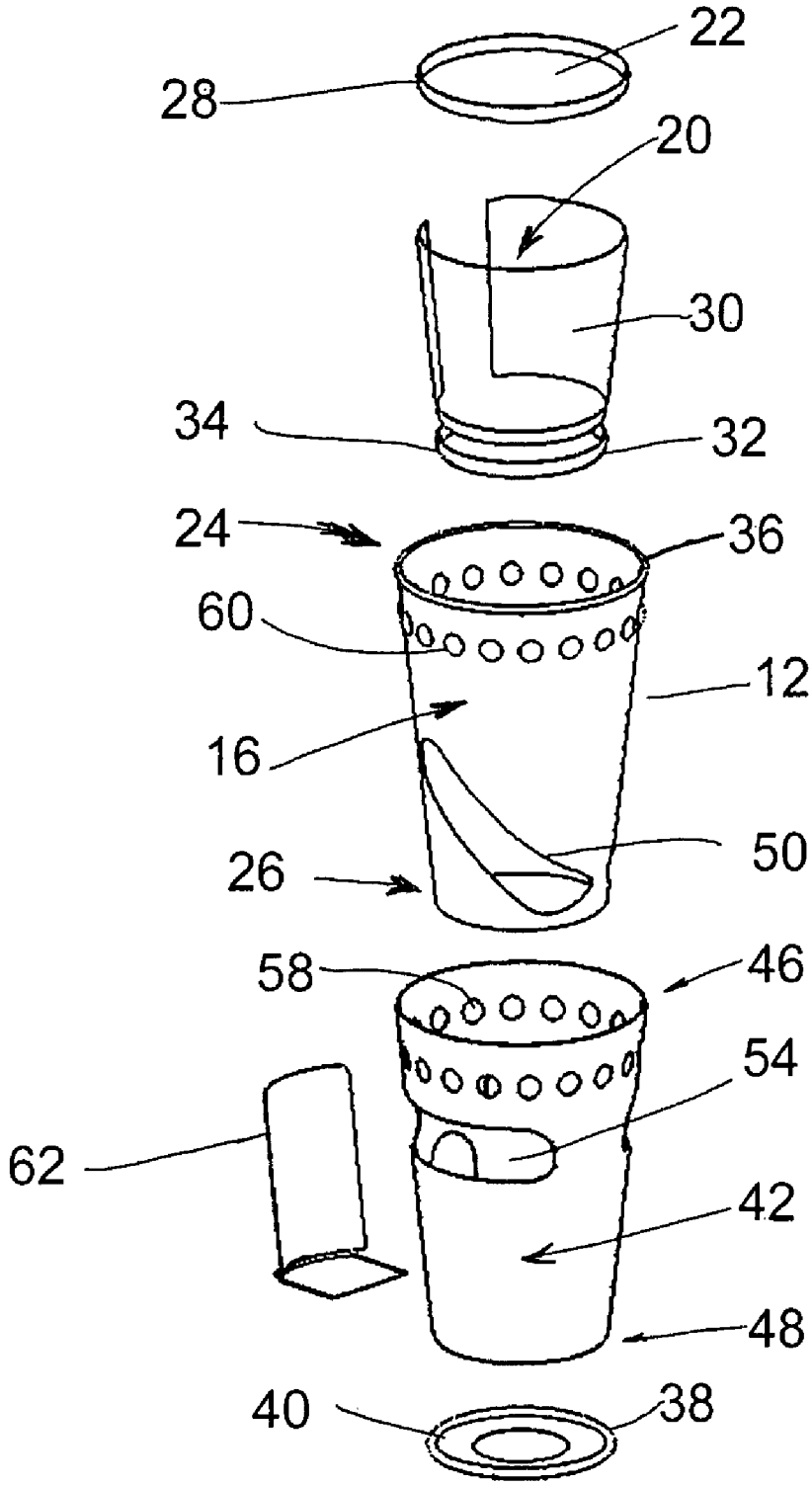
FIG. 6 is a fully exploded back view of the food container of FIG. 2.
Figure 7:
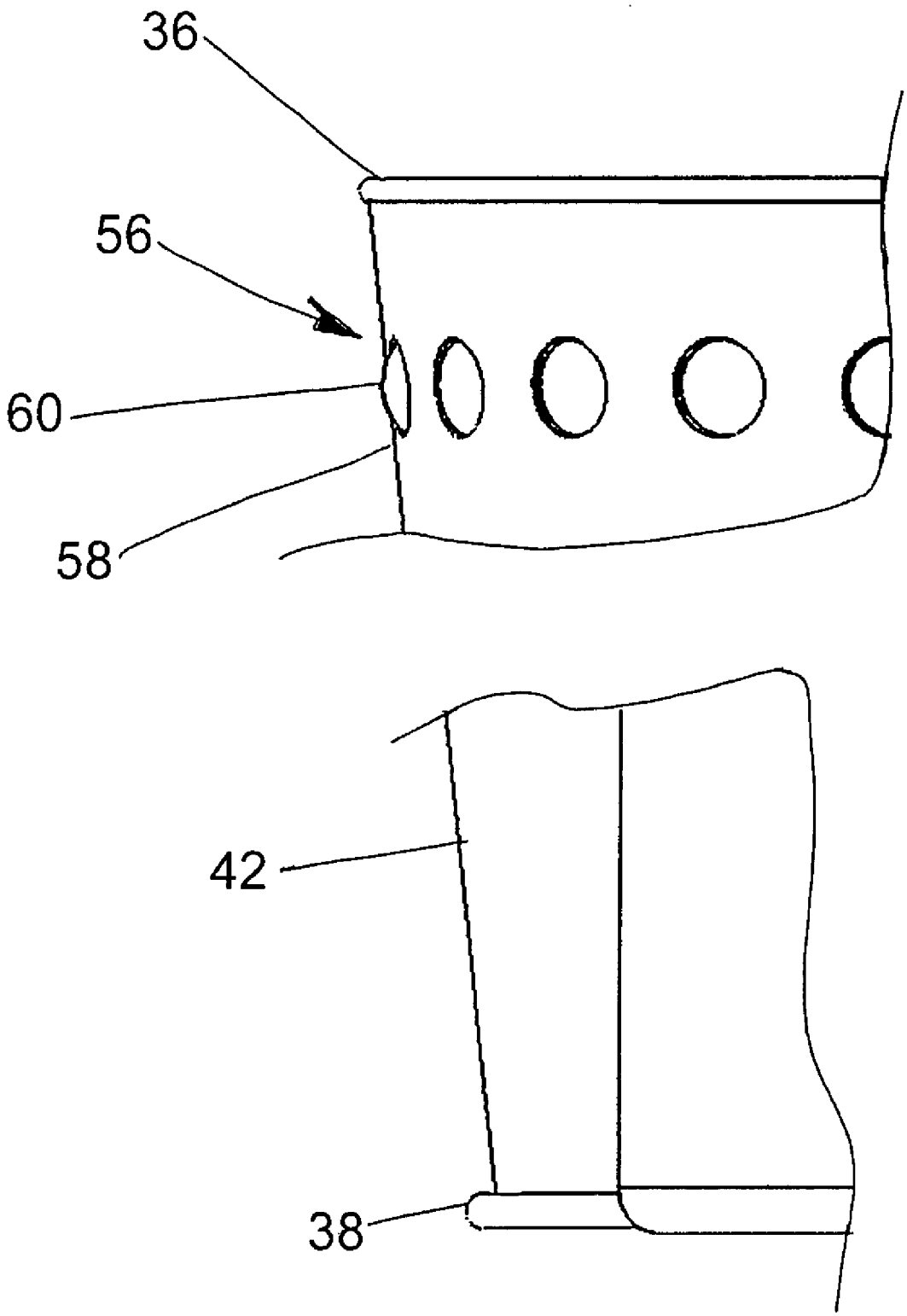
FIG. 7 is an isolated side view of the upper end and lower end of the food container of FIG. 1.

Inner cup 12, best shown in FIGS. 3 and 4, has a first wall 16 that encloses an upper receptacle 18 and a lower chamber 20, which are separated by divider 22 disposed between the upper end 24 and the lower end 26 of first wall 16. In the embodiment shown in FIG. 5, divider 22 has an upwardly extending, peripherally disposed lip 28 that is configured to engage the inner surface of first wall 16. An attachment mechanism, such as an adhesive or heat staking, is utilized to secure divider 22 inside inner cup 12. In a preferred embodiment of the food container 10 of the present invention, the lower chamber 20, below divider 22, comprises a product freshness seal 30 selected to separate the food product from the inner surface of first wall 16 at lower chamber 20, as shown in FIG. 5. Typically, inner cup freshness seal 30 will be attached to the inner surface of first wall 16 in a manner that is appropriate for the desired bonding of the materials used for these components. As described in more detail below, freshness seal 30 should be configured so the user can relatively easily pierce it in order to allow access to the food products inside lower chamber 20. In one embodiment, freshness seal 30 is constructed out of a lightweight plastic film or disposable wax paper that, in addition to being easily pierced, can maintain a hygienic seal in lower chamber 20. In an alternative embodiment, freshness seal 30 is a self-adhesive liner member that is punctured and then removed by the consumer. In yet another alternative embodiment of the present invention, freshness seal 30 is not utilized with food container 10. The lower end 26 of inner cup 12 is closed to seal the food product inside lower chamber 20. In one embodiment, inner cup 12 is provided with an inner cup base 32, having an upwardly extending, peripherally disposed lip 34, that is attached to first wall 16 in the manner described above for divider 22 or as may be suitable for the materials utilized therewith.

Inner cup 12 has an upper locking ring 36 circumferentially disposed at the upper end 24 of first wall 16 that is sized and configured to prevent outer sleeve 14 from sliding upward past the upper end 24 of inner cup 12 when inner cup 12 is rotatably disposed in outer sleeve 14. Upper locking ring 36 should also be configured so as to not interfere with the rotation of outer sleeve 14 around inner cup 12. Inner cup 12 also has a lower locking ring 38 peripherally disposed on a lower lock member 40 that attaches to inner cup base 32 to lock outer sleeve 14 between upper locking ring 36 and lower locking ring 38. Preferably, upper 36 and lower 38 locking rings prevent substantial vertical movement of outer sleeve 14 while allowing it to rotate relative to inner cup 12. As with divider 22 and inner cup base 32, lower lock member 40 attaches to inner cup base 32 using an adhesive, heat staking or other mechanisms suitable for the materials used therewith. In a preferred configuration, when the inner cup 12 and outer sleeve 14 are joined together, as shown in FIGS. 1 and 2, the first wall 16 of inner cup 12 is substantially adjacent to the second wall 42 of outer sleeve 14. As will be readily understood by those skilled in the art, various other mechanisms and/or configurations can be utilized to secure the rotatable and positioning relationship between inner cup 12 and outer sleeve 14.

The second wall 42 of outer sleeve 14 encloses a cup receiving chamber 44 that is open at the upper end 46 and lower end 48 of second wall 42. Preferably, outer sleeve 14 is sized and configured to be only slightly larger in width or diameter than inner cup 12 so that they generally nest together and substantially rotate about a common, central vertical axis. The height of outer sleeve 14 should be sufficiently less than the distance between upper 36 and lower 38 locking rings so that outer sleeve 14 will somewhat freely rotate around inner cup 12. In an alternative embodiment, not shown, the height of outer sleeve 14 is substantially less than the height of inner cup 12, such that the inner cup 12 extends somewhat above the top edge of outer sleeve 14.

Figure 8:
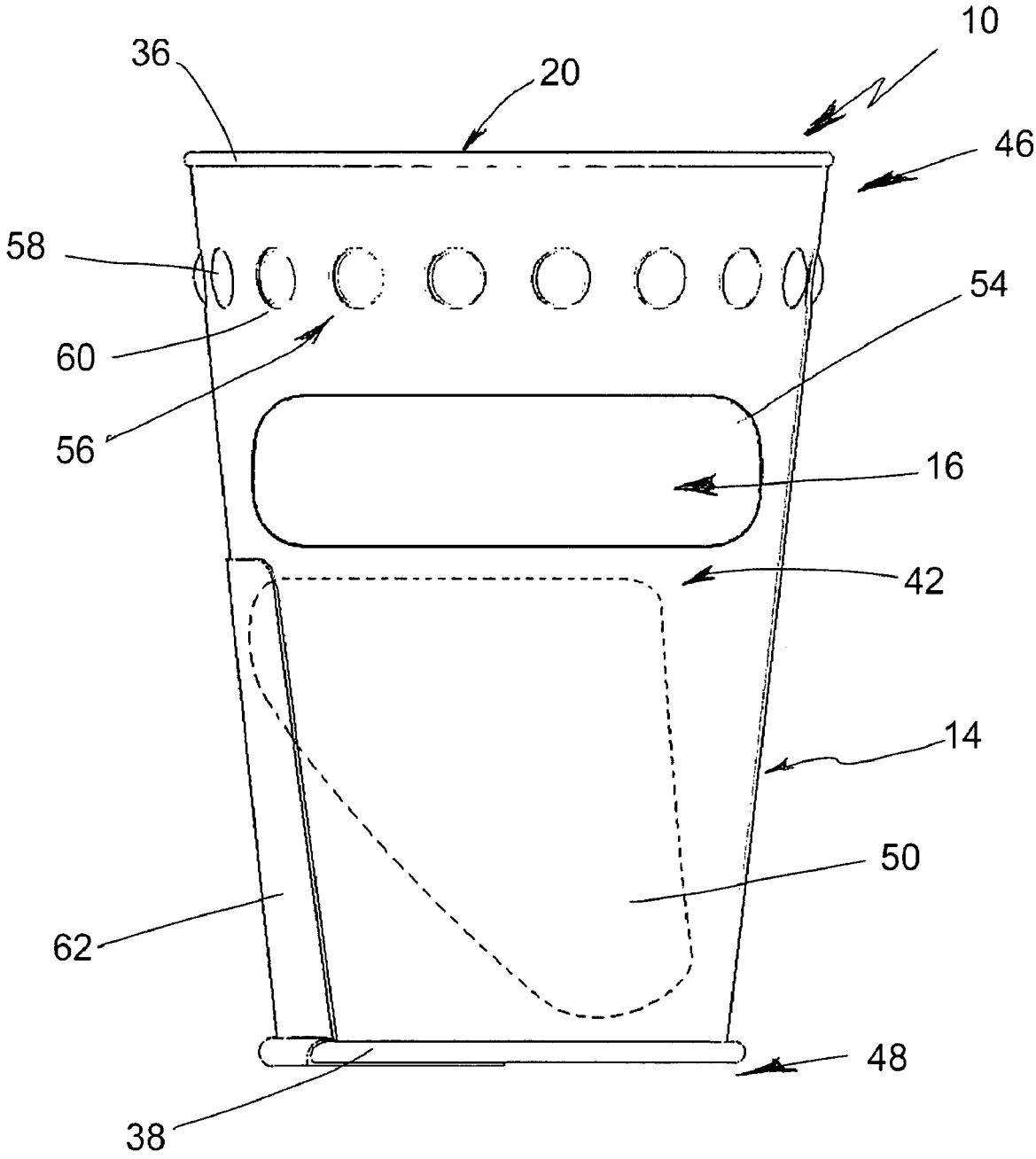
FIG. 8 is a side view of an alternative embodiment of the food container of the present invention showing the use of a larger sized inner dispensing opening in the inner cup.

To facilitate transfer of the food products from the lower chamber 20 to the consumer's hand and the rotation of outer sleeve 14 to inner cup 12, inner cup 12 and outer sleeve 14 of food container 10 are provided with a plurality of cut-outs. In a preferred embodiment, inner cup 12 has a pair of diagonal inner dispensing openings 50 in first wall 16. As best shown in FIG. 5, in a preferred embodiment inner dispensing openings 50 are in the form of two diagonal slashes or slots that peak towards each other. Inner dispensing openings 50 are in communication with lower chamber 20 to allow food product to pass therethrough on its way to the consumer. In one embodiment, inner dispensing openings 50 cross the height of first wall 16 from divider 22 to inner cup base 32. In an alternative embodiment, shown in FIG. 8, inner dispensing opening 50 is configured as a larger, generally triangular shaped opening that gets larger as it opens from left to right, thereby allowing more or larger sized food products to be dispensed out of food container 10. Outer sleeve is provided with an outer dispensing opening 52, typically in the form of a vertical slot, through which the food products pass from the lower chamber 20 to the consumer. Preferably, the width of outer dispensing opening 52 is less than, or at most generally equal to, the distance between the inner dispensing openings 50 such that, when desired, the outer sleeve 14 can be rotated so the outer dispensing opening 52 is not aligned with either of the inner dispensing openings 50 (i.e., the slots are all closed). When the consumer desires to obtain some of the food product from inside lower chamber 20, he or she rotates outer sleeve 14 until the outer dispensing opening 52 is generally aligned with at least a portion of one of the inner dispensing openings 50, thereby providing a path for the food products from lower chamber 20 to the consumer's hand or mouth.

In the preferred embodiment, outer sleeve 14 is also configured with a grip slot 54 that opens to the outer surface of first wall 16 of inner cup 12, as best shown in FIGS. 1, 2, 3, 5 and 6. The purpose of grip slot 54 is to provide a gripping surface for contact against inner cup 12 to permit rotation of outer sleeve 14 relative to inner cup 12. In a preferred configuration, as shown, grip slot 54 is a generally horizontal slot that extends partially around the circumference of first wall 16. If desired, food container 10 can also be provided with an indexing mechanism, shown generally as 56, that indexes the rotation of outer sleeve 14 relative to inner cup 12. In a preferred embodiment, indexing mechanism 56 comprises a plurality of detent holes 58 at or near the upper end 46 of outer sleeve 14 that are cooperatively configured and aligned with a plurality of detent bumps 60 such that the detent bumps 60 are sequentially received in detent holes 58 as outer sleeve 14 rotates around inner cup 12.

To secure the food product inside food container 10 until the consumer is ready to enjoy it, the preferred food container 10 also comprises a removable cover 62 affixed to the second wall 42 of outer sleeve 14 at outer dispensing opening 52, as best shown in FIGS. 1, 3, 5 and 6. Preferably, the removable cover 62, which is an outer freshness sticker, is configured to prevent outer sleeve 14 and inner cup 12 from rotating when it is in place, thereby keeping the inner dispensing openings 50 from becoming aligned with outer dispensing opening 52. Removable cover 62 will help ensure the freshness of the product inside the lower chamber 20. In the preferred embodiment, removable cover is secured to the outer sleeve 14, inner cup 12 and lower locking ring 38 by a suitable removable adhesive. When the consumer is ready to consume the food product, he or she removes removable cover 62 to allow inner cup 12 and outer sleeve 14 to rotate relative to each other. This rotation will bring inner dispensing openings 50 in alignment with outer dispensing openings 52.

During the manufacturing process, the inner cup 12 is inserted into the outer sleeve 14 and rotated such that the inner dispensing openings 50 are not in alignment with the outer dispensing opening 52, which is covered with the removable cover 62. The inner cup base 32 is lowered to the lower end 48 of second wall 42 and the lower lock member 40 is affixed to the inner cup base 32 with the lower locking ring 38 at lower end 48 of second wall 42. If used, the freshness seal 30 is placed inside lower chamber 20, the food product is placed in lower chamber 20 and then divider 22 is put in place to separate lower chamber 20 from upper receptacle 18. The food container 10 is prepared for shipping by placing a plurality of such containers in a "sleeve" style orientation, much like the stacking arrangement for disposable paper cups. Upon arrival at the point of sale, the food containers 10 are either stacked (as shipped) or placed on a standard peg like device, which can pass through symmetrical holes in the inner cup 12 and outer sleeve 14 to keep them from rotating while in a point of purchase situation.

Figure 9:
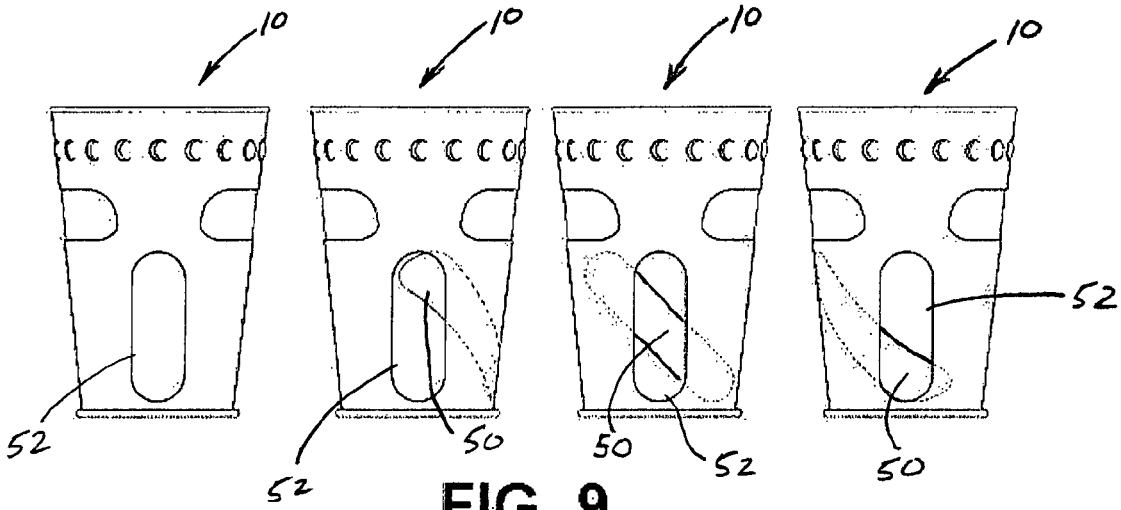
FIG. 9 is a sequential illustration of the opening, showing the rotation from left to right, of the food container of FIG. 1.
Figure 10:
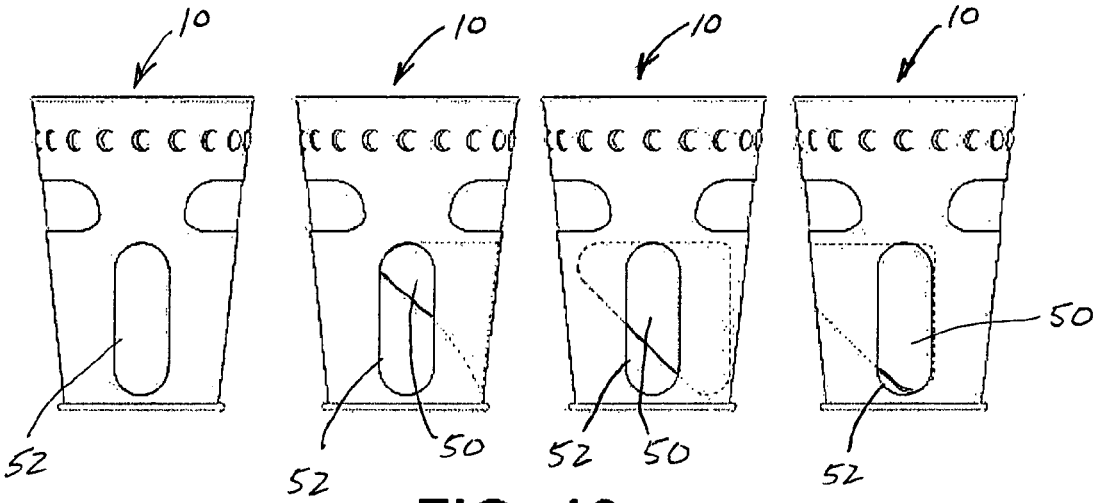
FIG. 10 is a sequential illustration of the opening, showing the rotation from left to right, of the food container of FIG. 8.

After receiving the food container 10, the consumer only has to perform a few steps in order to enjoy the food product in a clean manner. The consumer removes the removable cover 62 so that he or she may twist or rotate the outer sleeve 14 by utilizing the grip slot 54. When one of the diagonal slots of the inner dispensing openings 50 comes into alignment with the outer dispensing opening 52, the consumer punctures the freshness seal 30 with a finger. The visible opening will slide down the vertical slot of the outer dispensing opening 52 after additional rotation of the outer sleeve 14. This sequence is shown in FIG. 9. If used, the triangular configuration of FIG. 8 results in the opening gradually increasing in size as the outer sleeve 14 is rotated, as shown in the sequence set forth in FIG. 10. Once the user has the opening at the desired level, he or she merely pours or shakes a quantity of the food product out of the food container 10 onto his or her hand. A twist in the opposite direction on the outer sleeve 14 will close the food container 10, reduce the size of the opening or increase the height of the opening holes depending on the embodiment and previous rotational position. As stated above, one of the benefits of the food container 10 of the present invention is that its operation can be substantially one-handed, leaving the other hand available, if needed, for receiving the food product from the food container 10. The edible portion of the product can be consumed and the food-related waste spit or otherwise placed into the upper receptacle 18, where it will not contaminate the fresh food product in the lower chamber 20. Once all of the food product is consumed, the food container 10, with the food-related refuse, can be discarded into a trash container or placed in an appropriate recycling receptacle. If desired, a lid can be included with the food container 10 to close the food-related debris in the upper receptacle 18.

In an alternative embodiment or use of the present invention, the upper receptacle 18 can be utilized for a beverage, such as soda or beer, with the food product in the lower chamber 20. A lid and/or straw can be provided with the food container 10 to assist the consumer with carrying or consuming the beverage. Once the beverage is consumed, the consumer can utilize the upper receptacle 18 for the food-related refuse as described above. If desired, the food product can be selected to "correspond" with the beverage. For instance, wine or a martini can be placed in the upper receptacle 18 and olives can be placed in the lower chamber 20.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. A food container for packaging and serving a food product having food-related refuse, said food container comprising:

an inner cup having a first wall enclosing an upper receptacle and a lower chamber between an upper end of said first wall and a lower end of said first wall, said upper end of said first wall substantially open and said lower end closed, said lower chamber configured to store the food product therein and said upper end configured to receive the food-related refuse therein, said first wall having an inner dispensing opening in communication with said lower chamber to allow the food product to pass therethrough; and an outer sleeve having a second wall enclosing a cup receiving chamber substantially open at said upper end of said second wall, said inner cup rotatably received in said outer sleeve through said open upper end thereof, said second wall having an outer dispensing opening configured to selectively dispense the food product from said food container when aligned with said inner dispensing opening.

2. A food container according to claim 1 further comprising a lower locking member attached to said lower end of said inner cup.

3. A food container according to claim 2, wherein said lower locking member comprises a lower locking ring.

4. A food container according to claim 3, wherein said inner cup has an upper locking ring at an upper end thereof, said outer sleeve disposed between said upper locking ring and said lower locking ring so as to prevent vertical movement of said outer sleeve beyond said upper locking ring and said lower locking ring.

5. A food container according to claim 4, wherein said upper locking ring, said lower locking ring and said outer sleeve are cooperatively sized and configured to prevent substantial vertical movement of said outer sleeve.

6. A food container according to claim 1 further comprising an indexing mechanism.

7. A food container according to claim 6, wherein said indexing mechanism comprises a plurality of detent bumps on said inner cup and a plurality of cooperatively configured and positioned detent holes on said outer sleeve.

8. A food container according to claim 1, wherein said outer sleeve further comprises a means for rotating said outer sleeve relative to said inner cup.

9. A food container according to claim 8, wherein said rotating means comprises a grip slot in said second wall, said grip slot open to allow contact with said first wall of said inner cup.

10. A food container according to claim 1, wherein said upper receptacle and said lower chamber are separated by a divider.

11. A food container according to claim 1, wherein said inner dispensing opening in said first wall of said inner cup comprises a pair of diagonally positioned slots in spaced apart relation.

12. A food container according to claim 1 further comprising a freshness seal in said lower chamber.

13. A food container according to claim 1 further comprising a removable cover closing said outer dispensing opening.

14. A food container according to claim 13, wherein said removable cover is further configured to prevent rotation of said outer sleeve relative to said inner cup.

15. A food container for packaging and serving a food product having food-related refuse, said food container comprising:

an inner cup having a first wall enclosing an upper receptacle and a lower chamber between an upper end of said first wall and a lower end of said first wall, said upper receptacle and said lower chamber separated by a divider, said upper end of said first wall substantially open and said lower end closed, said lower chamber configured to store the food product therein and said upper end configured to receive the food-related refuse therein, said first wall having an inner dispensing opening in communication with said lower chamber to allow the food product to pass therethrough;

an outer sleeve having a second wall enclosing a cup receiving chamber substantially open at said upper end of said second wall, said inner cup rotatably received in said outer sleeve through said open upper end thereof, said second wall having an outer dispensing opening configured to selectively dispense the food product from said food container when aligned with said inner dispensing opening; and a removable cover configured to close said outer dispensing opening and prevent rotation of said outer sleeve relative to said inner cup.

16. A food container according to claim 15, wherein said inner cup has an upper locking ring at an upper end thereof and a lower locking ring at a lower end thereof, said outer sleeve disposed between said upper locking ring and said lower locking ring so as to prevent substantial vertical movement of said outer sleeve.

17. A food container according to claim 16 further comprising a rotating indexing mechanism.

18. A food container for packaging and serving a food product having food-related refuse, said food container comprising:

an inner cup having a first wall enclosing an upper receptacle and a lower chamber between an upper end of said first wall and a lower end of said first wall, said upper receptacle and said lower chamber separated by a divider, said upper end of said first wall substantially open and said lower end closed, said lower chamber configured to store the food product therein and said upper end configured to receive the food-related refuse therein, said first wall having an inner dispensing opening in communication with said lower chamber to allow the food product to pass therethrough;

an outer sleeve having a second wall enclosing a cup receiving chamber substantially open at said upper end of said second wall, said inner cup rotatably received in said outer sleeve through said open upper end thereof, said second wall having an outer dispensing opening configured to selectively dispense the food product from said food container when aligned with said inner dispensing opening; and means for rotating said outer sleeve relative to said inner cup, said rotating means configured to allow the consumer to selectively align said outer dispensing opening with said inner dispensing opening.

19. A food container according to claim 18, wherein said inner cup has an upper locking ring at an upper end thereof and a lower locking ring at a lower end thereof, said outer sleeve disposed between said upper locking ring and said lower locking ring so as to prevent substantial vertical movement of said outer sleeve.

20. A food container according to claim 18 further comprising a removable cover configured to close said outer dispensing opening and prevent rotation of said outer sleeve relative to said inner cup.

* * * * *